US006536060B1

(12) United States Patent
Janssens et al.

(10) Patent No.: US 6,536,060 B1
(45) Date of Patent: Mar. 25, 2003

(54) METHOD AND MONITORING DEVICE FOR MONITORING A WASH PROCESS

(75) Inventors: Jean Paul Janssens, Vlaardingen (NL); Henk Leeuwis, Enschede (NL); John Lloyd, Bebington-Wirral (GB); Petrus Jacobus Van Der Mark, Delft (NL); Arie Michiel Poos, Vlaardingen (NL)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/625,683

(22) Filed: Jul. 26, 2000

(30) Foreign Application Priority Data

Jul. 27, 1999 (EP) ..... 99202465

(51) Int. Cl.[7] ..... D06F 33/02

(52) U.S. Cl. ..... 8/159; 68/13 R; 68/213; 134/113; 134/18; 134/56 R

(58) Field of Search ..... 134/56 R, 57 R, 134/58 R, 113, 18; 68/12.02, 13 R, 213, 235 R; 8/158, 159

(56) References Cited

U.S. PATENT DOCUMENTS

| | | | | |
|---|---|---|---|---|
| 3,896,827 | A | | 7/1975 | Robinson |
| 3,933,612 | A | | 1/1976 | Fischer et al. |
| 3,982,893 | A | * | 9/1976 | Joslyn |
| 4,180,199 | A | * | 12/1979 | O'Rourke et al. |
| 4,311,793 | A | * | 1/1982 | Halleck |
| 4,591,566 | A | * | 5/1986 | Smith |
| 4,829,812 | A | | 5/1989 | Parks et al. |
| 4,850,716 | A | * | 7/1989 | Baker et al. |
| 4,863,867 | A | * | 9/1989 | Joyce et al. |
| 5,089,809 | A | * | 2/1992 | Carmichael, Jr. |
| 5,259,219 | A | * | 11/1993 | Dausch et al. |
| 5,291,626 | A | * | 3/1994 | Molnar et al. |
| 5,422,276 | A | * | 6/1995 | Colvin |
| 5,491,092 | A | * | 2/1996 | Colvin |
| 5,565,634 | A | * | 10/1996 | Graessle et al. |
| 5,603,233 | A | | 2/1997 | Erickson et al. |
| 5,923,432 | A | * | 7/1999 | Kral |
| 6,193,931 | B1 | * | 2/2001 | Lin et al. |
| 6,394,111 | B1 | * | 5/2001 | Jacobs et al. |

FOREIGN PATENT DOCUMENTS

| | | | |
|---|---|---|---|
| DE | 4031981 | A1 | 4/1992 |
| EP | 0 205 671 | A1 | 6/1985 |
| EP | 0 175 552 | A2 | 9/1985 |
| GB | 2 280 767 | A | 4/1993 |
| JP | 3-274420 | * | 12/1991 |
| WO | 97/09480 | | 3/1997 |

* cited by examiner

*Primary Examiner*—Frankie L. Stinson
(74) *Attorney, Agent, or Firm*—Ronald A. Koatz

(57) ABSTRACT

The present invention relates to a method and monitoring device for monitoring a wash process inside a washing apparatus, the method comprising the steps of introducing into the washing apparatus a monitoring device suitable for measuring physical and/or mechanical parameters of the wash process and recording the measured parameters within the monitoring device. A self-contained and wireless monitoring device is used.

21 Claims, 3 Drawing Sheets

METHOD AND MONITORING DEVICE FOR MONITORING A WASH PROCESS

The present invention firstly relates to a method for monitoring a wash process inside a washing apparatus, comprising the steps of introducing into the washing apparatus a monitoring device suitable for measuring physical and/or mechanical parameters of the wash process and recording the measured parameters within the monitoring device. Secondly, the present invention relates to a monitoring device for monitoring a wash process inside a washing apparatus, comprising means for measuring physical and/or mechanical parameters of the wash process and means for recording the measured parameters within the monitoring device.

Methods and monitoring devices for monitoring a wash process inside a washing apparatus are known from the state of the art. According to the known methods monitoring devices are often positioned in static parts of the washing apparatus, for example the wall of the static outer drum in a double drum washing machine, or in the outlet reservoir or in a static cavity specifically designed for this purpose.

U.S. Pat. No. 5,603,233 describes means for measuring a plurality of physical parameters within a machine for washing articles. The electrical connection with these means is provided via a plug and the means are fixed in a pump housing.

EP-A-0.205.671 describes a measuring-cell positioned inside the drum of a industrial washing machine for measuring a physical parameter, for example the conductivity of the wash bath solution. This measuring-cell has a fixed position on the inside of the drum and is capable of rotation therewith. For the electrical connection a sliding contact in the shaft of the washing machine has to be provided.

The state of the art mentioned above suffers from a number of drawbacks. The means provided for measuring a physical parameter often will only monitor one phase of the wash process, because these means often have a fixed position relative to a specific part (movable or not-movable) of the washing apparatus. Further, when these means are attached to a moving part of the washing apparatus, complicated connection means are necessary for obtaining an electrical connection. Such connection means make it difficult to remove the monitoring device from the washing apparatus for subsequent use in another washing apparatus.

Therefor, it is an object of the present invention to provide a method as well as a monitoring device of the type as stated above which do not suffer from these drawbacks.

Thus, in a first aspect of the invention a method for monitoring a wash process inside a washing apparatus is provided, comprising the steps of introducing into the washing apparatus a monitoring device suitable for measuring physical and/or mechanical parameters of the wash process and recording the measured parameters within the monitoring device, characterised in that a self-contained and wireless monitoring device is used.

Within the context of the present application "self-contained and wireless" means that for its operation the device needs no physical connection with an external source, such as an energy source, processing unit or alike. Because the monitoring device is self-contained and wireless, it can be positioned at different locations inside the washing apparatus, and thus will be able to monitor the whole wash process from the beginning to the end. In this context, the device may, notwithstanding its self-contained and wireless character, temporarily be attached to any part of the washing apparatus, e.g. a rotating drum, but it may also be positioned loosely inside the washing apparatus, e.g. on top of laundry. Further, because the monitoring device is self-contained and wireless, there is no need for complicated electrical connections, and removing the device is extremely simple.

The method according to the invention may be applied to different wash processes. Thus it is possible, that the wash process is a domestic laundry wash process, wherein the monitoring device is introduced into a revolving drum of a washing machine. Another possibility is, that the wash process is an industrial laundry wash process, wherein the monitoring device is introduced into a tunnel washing machine. In this latter case the device will follow the laundry through the entire tunnel, thus measuring at all different stages of the wash process.

However, the method according to the invention not only is applicable to a laundry wash process, but also to a dish wash process. Thus, the wash process might be a domestic dish wash process, wherein the monitoring device is introduced into a dish washer, but also the wash process might be an industrial dish wash process, wherein the monitoring device is introduced onto, and moves along with a conveyor belt of an industrial dish washer.

Until now methods have been described which are applicable to wash processes inside mechanical washing apparatus. However, the method according to the invention is not limited to such. The wash process also might be a hand wash process, wherein the monitoring device is introduced into a wash tub. In such a case the washing apparatus is defined by this wash tub.

Preferably, the method according to the invention is characterised by the additional step of reading out the recorded parameters. In this aspect, one possible solution is, that the step of reading out the recorded parameters comprises connecting the monitoring device with appropriate reading means. Although connecting the monitoring device with appropriate reading means might be carried out while the monitoring device is still positioned inside the washing apparatus, according to a preferred embodiment the monitoring device is removed from within the washing apparatus previous to reading out.

When, according to another preferred embodiment of the method according to the invention, the reading means are connected to, or provided with processing means for processing the read-out parameters, processing the parameters already can occur in the monitoring device.

When the connection between the monitoring device and the reading means is wireless, reading out the parameters also may occur while the washing apparatus is still operative.

The method according to the invention further may be characterised by the step of dosing a cleaning agent as based upon the measured physical and/or mechanical parameters. Dosing a cleaning agent then occurs during the wash process.

Although the monitoring results may be related back to the washing apparatus for dosing such a cleaning agent as based upon the measured physical and/or mechanical parameters, according to another preferred embodiment of the method according to the invention the dosing of the cleaning agent is carried out by the monitoring device. As a result, a standard washing apparatus may be used without the need of modifications.

In a second aspect the present invention provides a monitoring device for monitoring a wash process inside a washing apparatus, comprising means for measuring physical and/or mechanical parameters of the wash process and means for recording the measured parameters within the monitoring device, characterised in that the monitoring device is self-contained and wireless.

Such a self-contained and wireless monitoring device is extremely fit for monitoring a wash process inside a washing apparatus. The wash process may be any of wash processes as defined in respect of the method according to the invention.

Preferably, the monitoring device according to the invention comprises means for exchanging the recorded parameters with an external device.

During the wash process the chosen parameters are monitored and recorded within the monitoring device. After the wash process is finished the parameters can be extracted from the monitoring device using the external device. For this purpose, the monitoring device may comprise a data exchange interface. Moreover, the data may be exchanged between the monitoring device and external device via a conductive link. The data exchange interface may work both ways, so that it is also possible to download information from the external device to the monitoring device.

The external device also might be the washing apparatus itself. Then, the monitoring device communicates the data directly to the washing apparatus wirelessly to control the wash process.

Preferably, the monitoring device according to the invention comprises means for processing the recorded parameters. Without being complete, such means may comprise AD/DA-converters, micro-controllers, and clock means.

According to another preferred embodiment, the monitoring device comprises means for dosing a cleaning agent as based upon the measured physical and/or mechanical parameters. In this embodiment the monitoring device is part of an automated dosing unit, wherein the monitoring device monitors the wash process and collects physical and chemical parameters of the wash liquor. These parameters are then related to the dosing means to control precisely the dosing of cleaning active agents throughout the wash process to ensure an optimal cleaning. The processing means mentioned before may be used for this purpose. In such an embodiment, the monitoring device will comprise at least one cleaning agent and the means to dose this agent. However, also several cleaning agents in several compartments maybe provided, which can be dosed separately.

It will be understood, that any agent useful in cleaning maybe used. A preferred cleaning agent comprises surfactant, builder, enzyme, bleach, bleach activator, bleach precursor, fluorescer, perfume, soil release polymer, anti redeposition polymer, softening agent and mixtures thereof.

In this case the monitoring device comprising the dosing means is placed inside the washing apparatus and measures the physical and/or mechanical parameters. These parameters are processed and relate to the dosing means to precisely dose the exact amount of cleaning agent at exactly the right time in the wash process. The advantage of this system is, that optimal cleaning is achieved for any degree of soiling, water hardness etc. without the need to use excess cleaning agent. After the wash process the monitoring device comprising the dosing means may be taken out of the washing apparatus and, if needed, the cleaning agent maybe refilled.

As stated before, the monitoring device according to the invention is self-contained. This means, that the monitoring device should have an internal energy source, such as a battery, rechargeable battery or alike.

For obtaining sufficient information about the wash process, the monitoring device according to the invention is provided with measuring means preferably comprising at least one sensor for measuring one of the following parameters: pH, conductivity, pCa, pNa, temperature, motion, turbidity and EC. In this aspect, motion also comprises acceleration. Any suitable sensor maybe used. The working range of the sensor of course will depend from the specific wash process to be monitored.

The sensor(s) will be connected to the recording means and/or processing means through an appropriate sensor interface.

For obtaining a correct measurement of the physical parameters of the wash process the monitoring device, in a preferred embodiment thereof, comprises a centrally located funnel-shaped entry channel for conducting washing liquid to be monitored to the measuring means. As a result, the washing liquid is effectively lead to the measuring means.

Preferably, the measuring means are provided in a sample reservoir at the end of the entry channel.

The parameters measured not only can be used for directly influencing the wash process (e.g. by dosing an agent) but olso for analysing this wash process (e.g. with computer means or alike).

The invention will be elucidated referring to the drawings in which an embodiment of a monitoring device according to the invention is shown.

Figure 1:
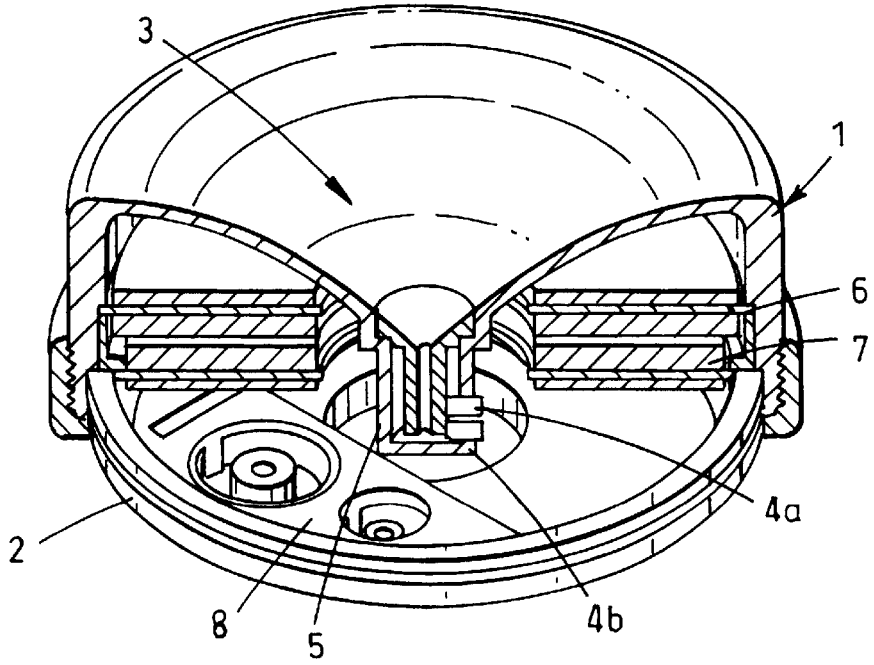
FIG. 1 shows, partly broken-away, a monitoring device according to the invention.
Figure 2:
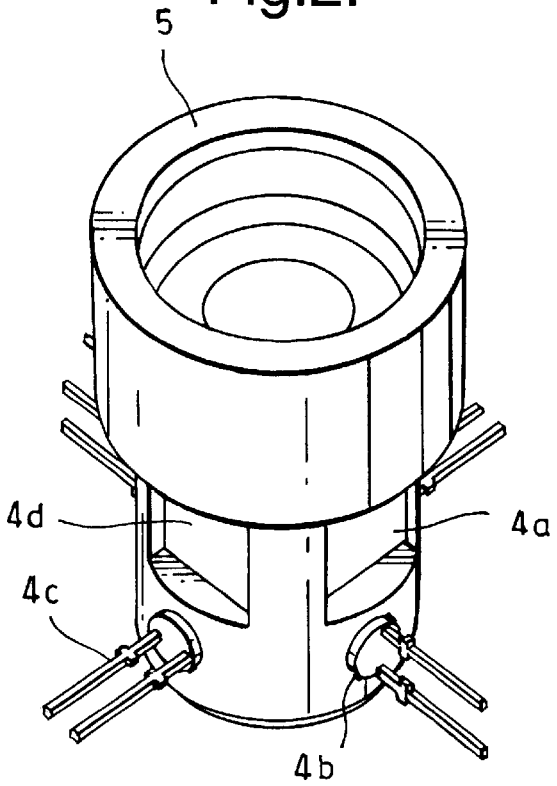
FIG. 2 shows, on a larger scale, a sample reservoir of the device of FIG. 1.
Figure 3:
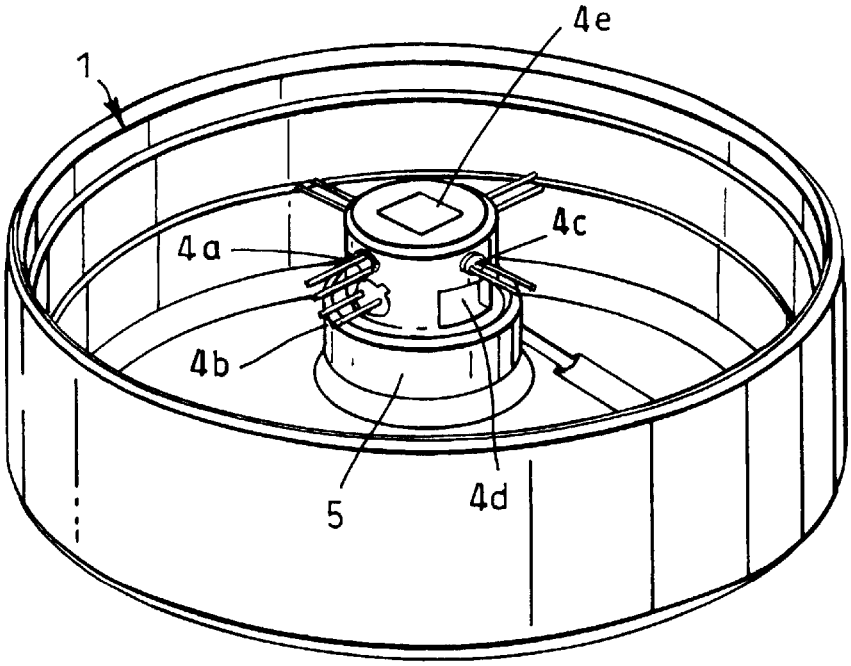
FIG. 3 shows a bottom view of the monitoring device of FIG. 1 with sample reservoir.

The monitoring device shown in the figures is used for monitoring a wash process inside a washing apparatus. The monitoring device comprises a housing 1, preferably made of plastic material. The housing 1 of the monitoring device should be waterproof to keep the inside (electronics etc.) dry. The housing may be made of perspex or epoxy resin or any other suitable material that is insensitive to chemicals used for cleaning, such as bleaches. The monitoring device in general, and the housing in particular, preferably has the necessary robustness so it may be used without any problem at the usual wash temperatures, preferably up to 95° Celsius and may withstand the usual mechanical actions, typically 20–70 rpm during washing and 100–1500 rpm during spinning. The monitoring device according to the invention is preferably reusable, say 50 times before replacement.

In the top of the housing 1 a centrally located funnel-shaped entry channel 3 is provided for conducting washing liquid to be monitored to measuring means 4 located near the bottom 2 of the housing 1.

The measuring means 4 comprises separate sensors 4*a*, 4*b*, 4*c*, 4*d*, 4*e* in a sample reservoir 5 at the end of the entry channel 3. A circular sensor print board 6 comprises the electronics for a sensor interface, whereas a circular processing and storage print board 7 comprises the electronics for processing means, such as a micro controller and storage means, such as a RAM.

Parameters measured by the sensors 4 will be exchanged with an external device (not shown) by exchanging means, for example an inductive link 8. This inductive link 8 also may be used for automatically recharging batteries 9 of the device when the monitoring device interacts with the external device. In such a case the batteries 9 are rechargeable.

Figure 4:
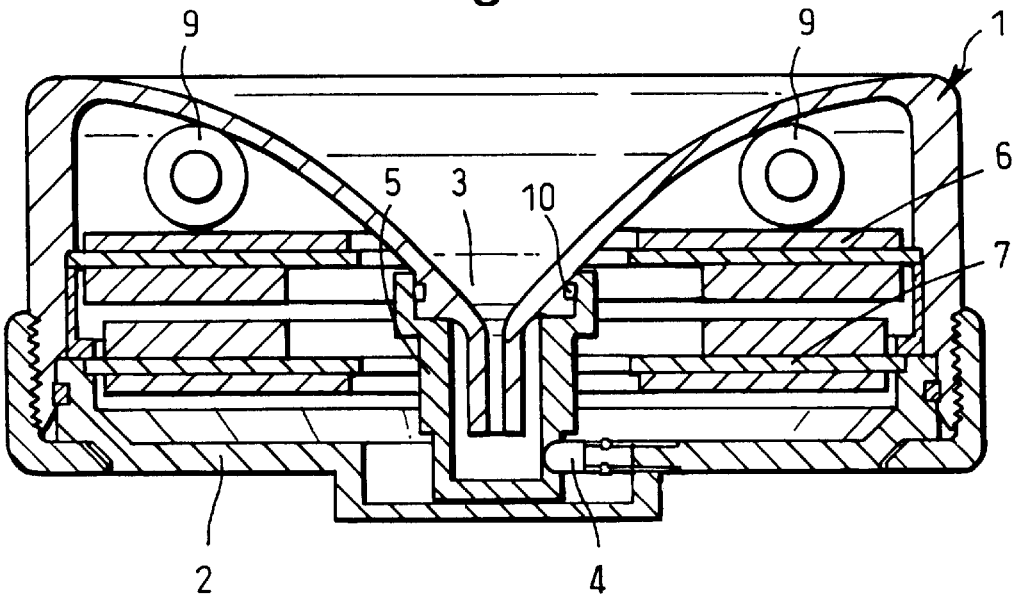
FIG. 4 shows a schematic cross-section of the monitoring device of FIG. 1.

Further, in FIG. 4 a waterproof seal 10 is shown to keep the washing liquid away from the electronics.

In the shown embodiment the monitoring device is disc-shaped. Typical dimensions are about 10 centimeters in diameter and 2–3 centimeters in height.

Figure 5:
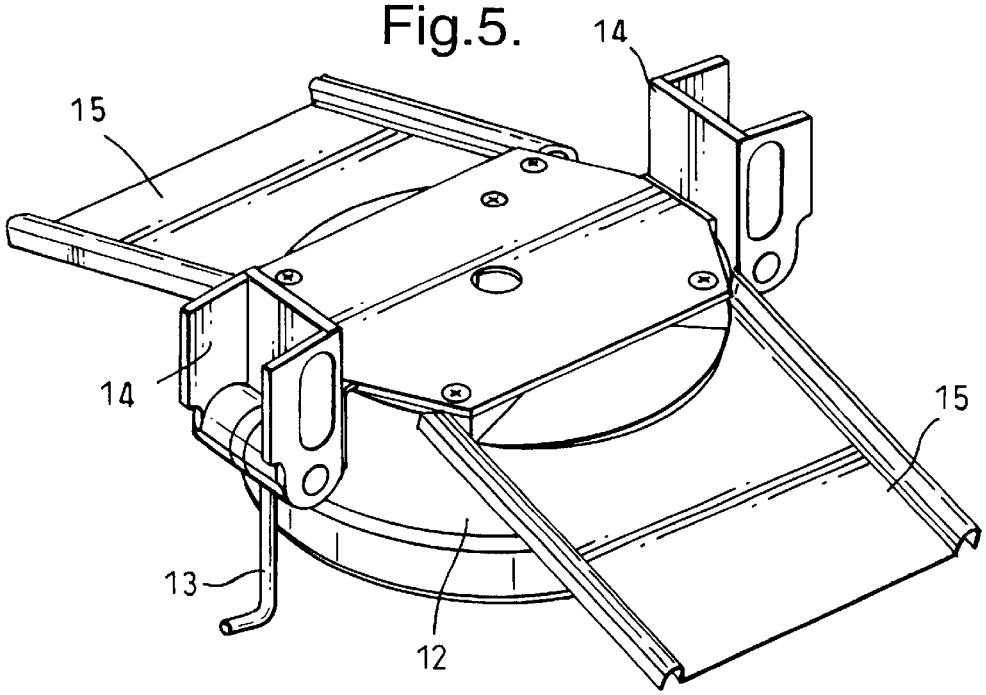
FIG. 5 shows another embodiment of the monitoring device.
Figure 6:
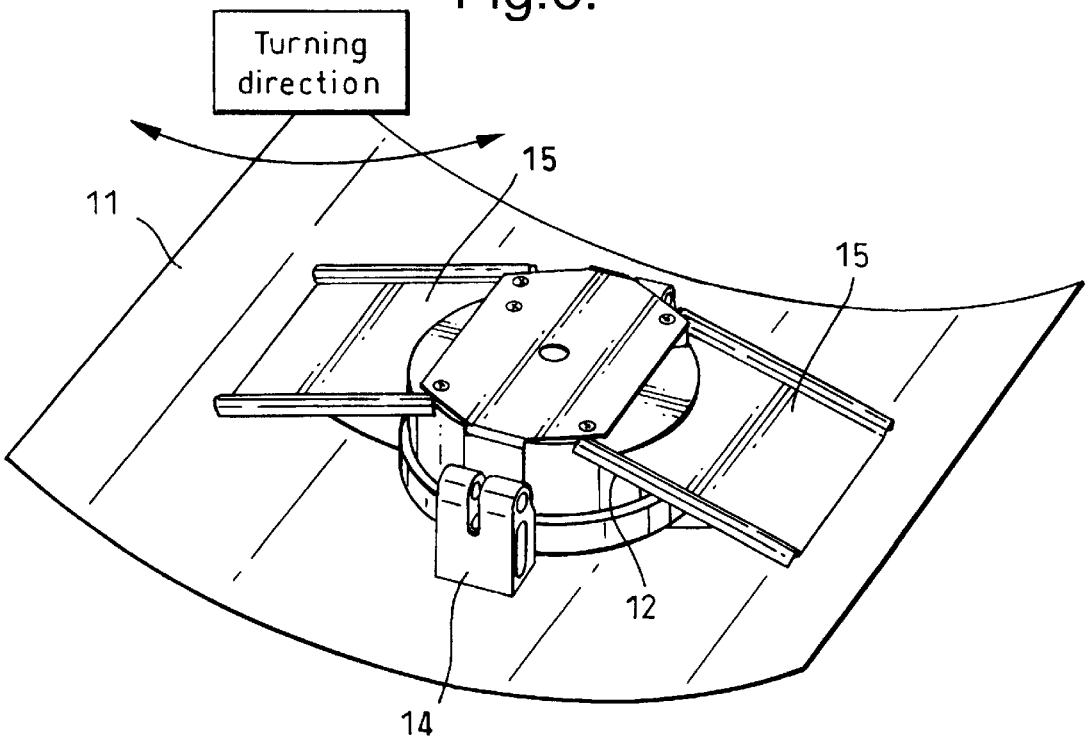
FIG. 6 shows the device of FIG. 5 attached to a drum of a washing machine.

In FIGS. 5 and 6 an embodiment of the monitoring device is illustrated which is to be attached to the inside of a rotating drum 11 of a washing machine. The monitoring device 12 comprises attachment arms 13 which can be hooked in holes in the drum 11. Covering caps 14 are provided for covering the arms 13. Sloping guides 15 will guide the laundry and washing liquid.

The invention is not limited to the embodiment described before, which may be varied widely within the scope of the invention as defined by the claims. Thus, the monitoring device also may comprise means for dosing a cleaning agent. Processing means on the processing and storage print board 7 may then be used for controlling such a dosing means. Instead of the inductive link 8 other means for exchanging the recorded parameters with an external device, contactless or not, may be applied, for example using optical means.

What is claimed is:

1. Method for monitoring a wash process inside a washing apparatus, wherein said process comprises:

(1) introducing into the washing apparatus a monitoring device suitable for measuring physical and/or mechanical parameters of the wash process;

(2) recording the measured parameters within the monitoring device;

and (3) using the recorded parameters such that the wash process can be controlled and/or analyzed;

wherein said monitoring device is self-contained and wireless.

2. Method according to claim 1, characterised in that the wash process is a domestic laundry wash process, wherein the monitoring device is introduced into a revolving drum of a washing machine.

3. Method according to claim 1, characterised in that the wash process is an industrial laundry wash process, wherein the monitoring device is introduced into a tunnel washing machine.

4. Method according to claim 1, characterised in that the wash process is a domestic dish wash process, wherein the monitoring device is introduced into a dishwasher.

5. Method according to claim 1, characterised in that the wash process is an industrial dish wash process, wherein the monitoring device is introduced onto, and moves along with a conveyor belt of an industrial dishwasher.

6. Method according to claim 1, characterised in that the wash process is a hand wash process, wherein the monitoring device is introduced into a washtub.

7. Method according to claim 1, characterised by the additional step of reading out the recorded parameters.

8. Method according to claim 1, characterised in that the step of reading out the recorded parameters comprises connecting the monitoring device with appropriate reading means.

9. Method according to claim 8, characterised in that previous to reading out the monitoring device is removed from within the washing apparatus.

10. Method according to claim 8, characterised in that the reading means are connected to, or provided with processing means for processing the read-out parameters.

11. Method according to claim 8, characterised in that the connection between the monitoring device and the reading means is wireless.

12. Method according to claim 1, characterised by the step of dosing a cleaning agent as based upon the measured physical and/or mechanical parameters.

13. Method according to claim 12, characterised in that the dosing of the cleaning agent is carried out by the monitoring device.

14. In combination:

(1) a washing apparatus; and (2) a monitoring device for monitoring a wash process inside said washing apparatus, wherein said monitoring device comprises means for measuring physical and/or mechanical parameters of the wash process and means for recording the measured parameters within the monitoring device; wherein said monitoring device is self-contained and wireless.

15. Monitoring device according to claim 14, characterised by means for exchanging the recorded parameters with an external device.

16. Monitoring device according to claim 14, characterised by means for processing the recorded parameters.

17. Monitoring device according to claim 14, characterised by means for dosing a cleaning agent as based upon the measured physical and/or mechanical parameters.

18. Monitoring device according to claim 14, characterised by an internal energy source, such as a battery, rechargeable battery or alike.

19. Monitoring device according to claim 14, characterised in that the measuring means comprise at least one sensor for measuring one of the following parameters: pH, conductivity, pCa, pNa, temperature, motion, turbidity and EC.

20. Monitoring device according to claim 14, characterised by a centrally located funnel-shaped entry channel for conducting washing liquid to be monitored to the measuring means.

21. Monitoring device according to claim 20, characterised in that the measuring means are provided in a sample reservoir at the end of the entry channel.

* * * * *